US010513319B1

(12) United States Patent
Beebe et al.

(10) Patent No.: US 10,513,319 B1
(45) Date of Patent: Dec. 24, 2019

(54) FLOATING VESSEL WITH INCREASING AND DECREASING CARGO CAPACITY SYSTEM

(71) Applicants: Anthony Beebe, Houston, TX (US); Jose H. Vazquez, West University, TX (US)

(72) Inventors: Anthony Beebe, Houston, TX (US); Jose H. Vazquez, West University, TX (US)

(73) Assignee: Asgard Marine Technologies LLC, Houston, TX (US)

( * ) Notice: Subject to any disclaimer, the term of this patent is extended or adjusted under 35 U.S.C. 154(b) by 0 days.

(21) Appl. No.: 16/298,499

(22) Filed: Mar. 11, 2019

Related U.S. Application Data

(63) Continuation of application No. 16/171,104, filed on Oct. 25, 2018, now Pat. No. 10,246,171.

(51) Int. Cl.
*B63B 45/04* (2006.01)
*B63B 45/00* (2006.01)

(52) U.S. Cl.
CPC ..... *B63B 45/04* (2013.01); *B63B 45/00* (2013.01); *B63B 2201/00* (2013.01); *B63B 2201/04* (2013.01)

(58) Field of Classification Search
CPC ... B63B 45/00; B63B 45/04; B63B 2045/005; B63B 2201/04; B63B 2201/08
See application file for complete search history.

(56) References Cited

U.S. PATENT DOCUMENTS 9,470,563 B1 * 10/2016 DeVerse ..... A61B 5/02
2017/0030798 A1 * 2/2017 DeVerse ..... G06F 19/00

* cited by examiner

*Primary Examiner* — Benyam Haile
(74) *Attorney, Agent, or Firm* — Nolte Intellectual Property Law Group

(57) ABSTRACT

Floating vessel with a buoyant hull for cargo, with a load line presentation device affixed to the buoyant hull without interrupting water flow along the buoyant hull the load line presentation device presenting: a baseline load line indicator plimsoll mark and a plurality of decreased capacity load line indicator plimsoll marks, with a decreased capacity model in memory connected to a processor in communication with the load line presentation device; configured for automatically integrating a plurality of variables including: wave size, wave period, wind speed, surface current, vessel length, type of vessel, quantity of disconnected superstructures, quantity of sheer, bow height, a port specific draft restriction, a canal specific draft restriction, and identifying decreased capacity load line plimsoll mark for a voyage of the floating vessel, the decreased capacity load plimsoll mark restricting baseline capacity of the buoyant hull from 1% to 50%.

12 Claims, 11 Drawing Sheets

FIG. 9

| | Decreased Capacity Model | | | |
|---|---|---|---|---|
| | Factor | Second Decreased Capacity Load Line Indicator Plimsoll Mark | First Decreased Capacity Load Line Indicator Plimsoll Mark | Deadweight |
| 202 | Wave size | 60 feet | 55 feet | 45 feet |
| 206 | Wave period | 15 seconds | 13 seconds | 11 seconds |
| 208 | Wind speed | 100 knots | 80 knots | 70 knots |
| 210 | Surface current | 1.5 knots | 1.0 knots | 0.75 knots |
| 212 | Length overall | 221 meters | 221 meters | 221 meters |
| 214 | Type of vessel | Barge | Barge | Barge |
| 216 | Quantity of Disconnected Superstructure | 2 | 2 | 2 |
| 218 | Quantity of Sheer | Zero | Zero | Zero |
| 220 | Bow height | 8 meters | 8 meters | 8 meters |
| 222 | Port specific draft restriction | 7.2 meters | 7.4 meters | 7.6 meters |
| 224 | Waterway specific draft restriction | 8.2 meters | 8.4 meters | 8.6 meters |
| 226 | Canal specific draft restriction | 9.2 meters | 9.4 meters | 9.6 meters |

FLOATING VESSEL WITH INCREASING AND DECREASING CARGO CAPACITY SYSTEM

CROSS REFERENCE TO RELATED APPLICATION

This present continuation in part application claims priority to and benefit of Co-Pending Non-Provisional application Ser. No. 16/171,104 filed Oct. 25, 2018 entitled: FLOATING VESSEL CARGO OPTIMIZATION SYSTEM which application is incorporated herein by reference.

SPECIFICATION

Field

The present embodiments generally relate to a floating vessel with a cargo control system.

Background

A need exists for a device to safely increase floating vessel cargo capacity.

The present embodiments meet these needs.

BRIEF DESCRIPTION OF THE DRAWINGS

The detailed description will be better understood in conjunction with the accompanying drawings as follows:

FIG. 9 is a table showing a barge and the specific conditions that define use of a baseline load line plimsoll mark during a voyage and two decreased capacity load line plimsoll marks.

Figure 1:
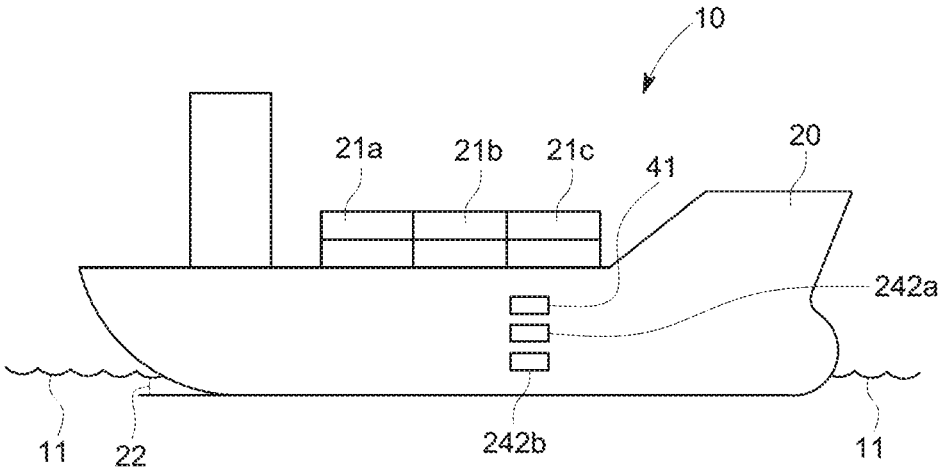
FIG. 1 depicts a side view of a floating vessel with multiple load line plimsoll marks.

The present embodiments are detailed below with reference to the listed Figures.

DETAILED DESCRIPTION OF THE EMBODIMENTS

Before explaining the present floating vessel in detail, it is to be understood that the floating vessel system is not limited to the particular embodiments and that it can be practiced or carried out in various ways.

The invention relates to a floating vessel with a buoyant hull for cargo.

The floating vessel has mounted to each side of the hull a load line presentation device positioned to avoid interrupting water flow along the buoyant hull.

The load line presentation device displays selectively a baseline load line indicator plimsoll mark or one of a plurality of decreased capacity load line indicator plimsoll marks.

The decreased capacity load line indicator marks are determined using a decreased capacity model in a first memory connected to a first processor in communication with the load presentation device.

The decreased capacity model is configured for automatically integrating a plurality of variables, including information about the floating vessel, amount of cargo and information about the environment including: wave height, wave period, wind speed, a surface current, vessel length, a type of vessel, a quantity of disconnected superstructures, a quantity of sheer force, and a bow height of the buoyant hull as measured from a keel; a port specific draft restriction, a waterway specific draft restriction, and a canal specific draft restriction.

The decreased capacity model identifies appropriate and safe increased capacity load line plimsoll marks for a voyage of the floating vessel.

The loadline presentation device allows for the display of the decreased capacity load plimsoll marks improving baseline capacity of the buoyant hull from 1% to 50%.

A benefit of the invention is that it decreases cargo carrying capacity of the vessel by 1 to 50%.

The invention enables more ships to enter shallow waterways, ports or canals.

This technology can be retrofitted to existing floating vessels, opening up the global commercial fleet to the benefits above. This can also be applied to new build vessels. The ability to apply this technology to nearly the entire commercial shipping fleet means the impact of the benefits will be far and wide.

The invention has the capacity to reduce the cost of goods at a destination by reducing the overall cost to move the goods.

The invention eliminates the risk of personnel hanging over a ship to manually paint new load line marks, and enables fast and easy change of load line marks without humans risking life or limb.

The following definitions are used herein:

The term "baseline load line mark" as used herein refers to the plimsoll mark on the hull as defined under International Convention on Load Lines signed in London 5 Apr. 1966 amended by the 1988 Protocol and Amended Consolidated Edition 2005 Supplement December 2013.

The term "buoyant hull" refers to a monohull, catamaran, or trimaran, or a column based hull. Examples of vessels with these hulls can be barges, cruise ships, container ships, and similar vessel classes.

The term "canal specific draft restriction" refers to a water depth for a specific navigable waterway known as a canal.

The term "decreased capacity load line mark" refers to a modified plimsoll mark created by a user and approved by a vessel classification regulatory society for use on the floating vessel whereby the floating vessel can reduce cargo due to changes based on geographic location including local weather, current or wind.

The term "Floating Vessel" includes Aframax, Capesize, Chinamax, Handymax (also known as Supramax), Handysize Malaccamax, Panamax, New Panamax, Q-Max, Seawaymax, Suezmax, Very Large Crude Carrier (VLCC), Ultra Large Crude Carrier (ULCC), Liquid Natural Gas Carrier (LNG), Bulk Carriers, General Cargo Carrier, Container Ship, Gas Carrier, Chemical Tanker, Ferry, Passenger Ships, Cruise Ships, Specialty Vessels, Mobil Offshore Drilling Unit (MODU), Oil Industry Vessels (pipe laying, seismic survey, accommodation vessels, etc.), Barge (many varieties), Offshore Supply Vessel, Floating Production Unit, Roll On/Roll Off (RoRo), and Fishing Vessels.

The term "fresh water load line mark (F)" as used herein refers to a component of the load line mark which represents how much load a particular hull can accept in fresh water.

The term "International Convention on Load Lines" refers to the International Convention on Load Lines signed in London 5 Apr. 1966 and it includes the amendments of the Protocol of 1988 relating to the International Convention on Load Lines, 1966 and revised as International Convention on Load Lines, 1966 and Protocol of 1988, as amended Consolidated edition, 2005 Supplement December 2013.

The term "manual power" refers to a person flipping a switch with their finger or an arm, and no motor, or fluid or electricity being required.

The term "port specific draft restriction" refers to a water depth for a specific navigable waterway known as a port.

The term "sheer" refers to a measure of longitudinal main deck curvature, in naval architecture. The upward curve formed by the main deck with reference to the level of the deck at the midship, is called sheer. It is usually given to allow flow of green water from the forward and aft ends to the midship and allow drainage to the bilges. The forward sheer is usually more than the aft sheer to protect the forward anchoring machinery from the waves. The sheer forward is usually twice that of sheer aft. Increases in the rise of the sheer forward and aft build volume into the hull, and in turn increase its buoyancy forward and aft, thereby keeping the ends from diving into an oncoming wave and slowing the ship. Sheer on exposed decks also makes a ship more seaworthy by raising the deck at fore and aft ends further from the water and by reducing the volume of water coming on deck.

The term "summer salt water load line mark (S)" as used herein refers to a component of the load line mark which represents how much load a particular hull can accept in salt water during summer months.

The term "tropical fresh water load line mark (TF)" as used herein refers to a component of the load line mark which represents how much load a particular hull can accept in tropical temperature fresh water.

The term "tropical salt water load line mark (T)" as used herein refers to a component of the load line mark which represents how much load a particular hull can accept in tropical temperature salt water.

The term "vessel classification regulatory society" refers to the American Bureau of Shipping, Bureau Veritas, Conarina, Germanischer Lloyd, Indian Register of Shipping, Biro Klasifikasi Indonesia, Lloyd's Register, Nippon Kaiji Kyokai, Det Norske Veritas, and Registro Italiano Navale.

The term "waterway specific draft restriction" refers to a water depth for a specific navigable waterway known as a waterway, such as a river, a bay or similar marine structure.

The term "winter North Atlantic salt water load line mark (WNA)" as used herein refers to a component of the load line mark which represents how much load a particular hull can accept in salt water during winter months in the North Atlantic at less than or equal to 36 degrees latitude.

The term "winter salt water load line mark (W)" as used herein refers to a component of the load line mark which represents how much load a particular hull can accept in salt water during winter months.

Turning now to the Figures, FIG. 1 depicts a side view of a floating vessel with multiple load line plimsoll marks.

The invention relates to a floating vessel 10 in water 11 with a buoyant hull 20 for cargo 21*abc*.

The ship can be a tanker, a cargo ship, a car carrier, or any number of floating vessels that load cargo, transport cargo, and offload cargo. In embodiments, the floating vessels can be liquefied natural gas carriers.

The buoyant hull has a draft 22. In embodiments, the buoyant hull has a propulsion system or an on board dynamic positioning system or combinations thereof.

The buoyant hull 20 is required under the International Convention on Load Lines signed in London, England, 5 Apr. 1966 amended by the Protocol of 1988 relating to the International Convention on Load Lines, 1966 and revised as International Convention on Load Lines, 1966 and Protocol of 1988, as amended Consolidated edition, 2005 Supplement December 2013 to display one load line indicator plimsoll mark 41 at a time as recognized by a vessel classification regulatory society.

On the side of the floating vessel is a baseline load line indicator plimsoll mark 41 representing an unrestricted service criteria for the floating vessel.

Each baseline load line indicator plimsoll mark is approved and issued by a vessel classification regulatory society, such as Lloyds of London™.

A plurality of decreased capacity load line indicator plimsoll marks 242*a* and 242*b* can be installed on the side of the floating vessel, but only one can be visible at a time.

Figure 2A:
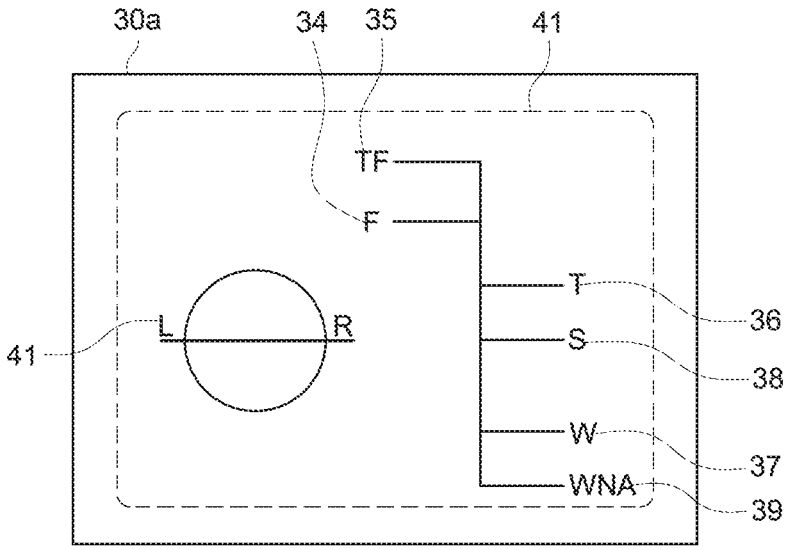
FIG. 2A depicts a detail of a baseline load line plimsoll mark.

FIG. 2A depicts a detail of a baseline load line plimsoll mark.

The invention includes a load line presentation device 30*a* affixed to the side of the buoyant hull 20 without interrupting water flow along the buoyant hull.

The load line presentation device 30*a* presents a baseline load line indicator plimsoll mark 41 that includes a fresh water load line mark 34; a tropical fresh water load line mark 35; a tropical salt water load line mark 36; a winter salt water load line mark 37; a summer salt water load line mark 38; and a winter North Atlantic salt water load line mark 39.

Figure 2B:
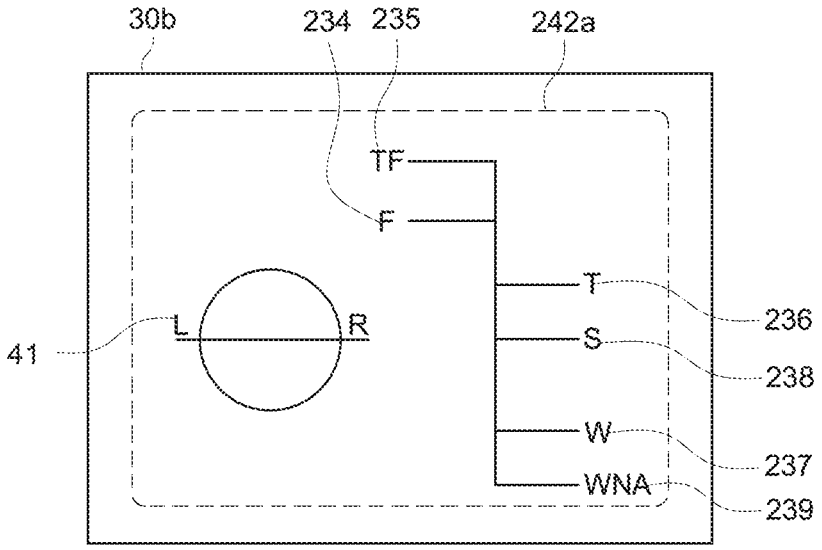
FIG. 2B depicts a detail of a decreased capacity load line plimsoll mark according to the invention.

FIG. 2B depicts a detail of a decreased capacity load line plimsoll mark.

FIG. 2B shows a decreased capacity load line indicator plimsoll marks 242*a* installed on a load line presentation device 30*b*.

Each decreased capacity load line plimsoll mark has a first fresh water load line mark 234; a first tropical fresh water load line mark 235; a first tropical salt water load line mark 236; a first winter salt water load line mark 237; a first summer salt water load line mark 238; and a first winter North Atlantic salt water load line mark 239.

Figure 3A:
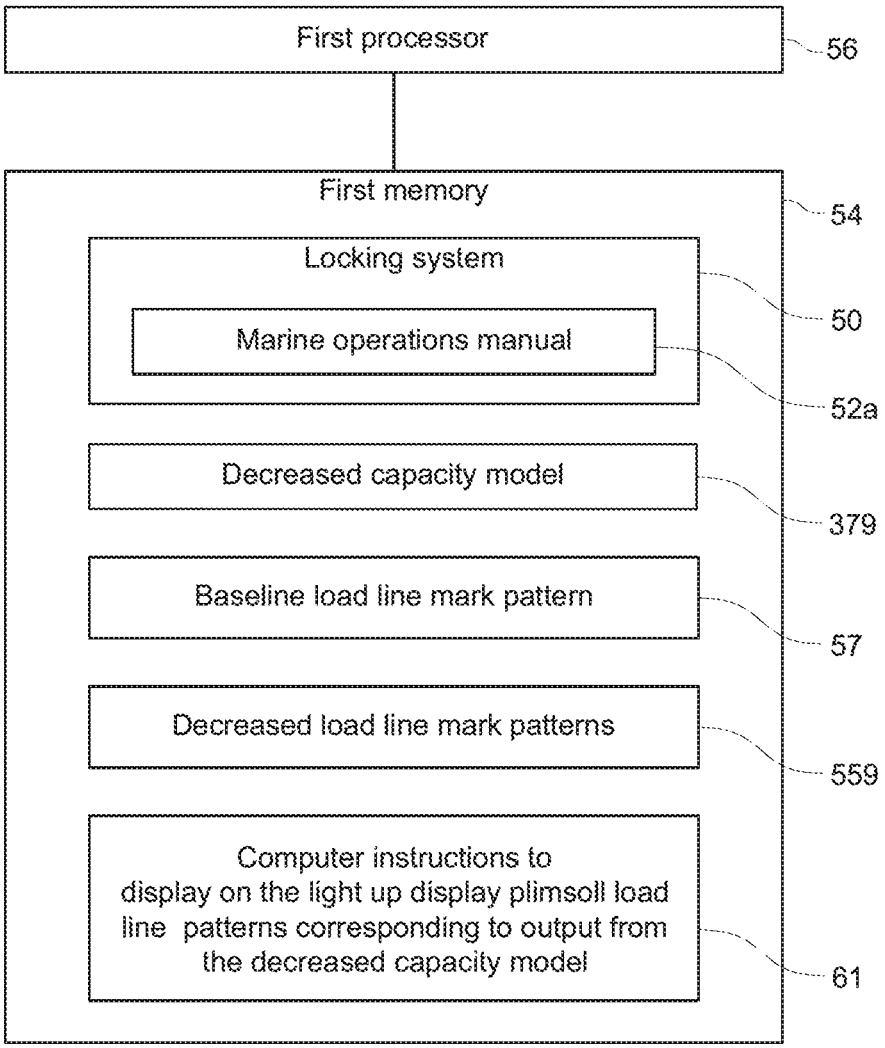
FIGS. 3A and 3B depict two mechanisms to isolate a marine operations manual according to the invention and a memory.
Figure 3B:
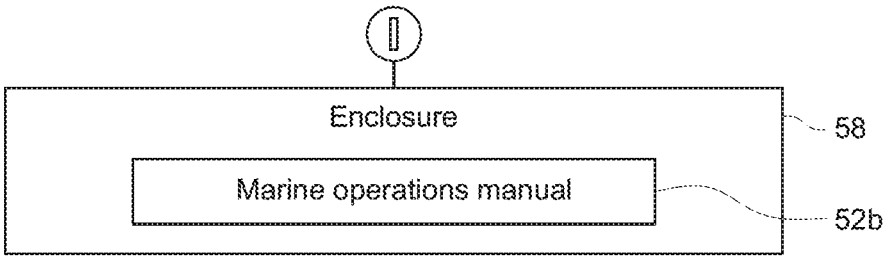

FIGS. 3A and 3B depict two mechanisms to isolate a marine operations manual according to the invention when an increased capacity load line plimsoll mark is used.

FIG. 3A shows a locking system 50 preventing access to a marine operations manual (MOM) 52*a* for loading, carrying, and offloading cargo using only the baseline load line plimsoll mark.

The marine operations manual 52*a* can be computer instructions in a first memory 54 connected to a first processor 56 or as shown in FIG. 3B, the locking mechanism can be an enclosure 58 containing a printed marine operations manual 52*b* in a locking enclosure 58.

FIG. 3A also depicts the decreased capacity model 379, as well as baseline load line mark pattern 57 and decreased load line mark patterns 559.

The last two patterns are used by the processor to illuminate a display on the side of the buoyant hull to depict a desired increased capacity or baseline load line mark.

FIG. 3A depicts computer instructions to display on the light up display, shown in a later embodiment, plimsoll load line patters corresponding to output from the decreased capacity model 61.

Figure 4A:
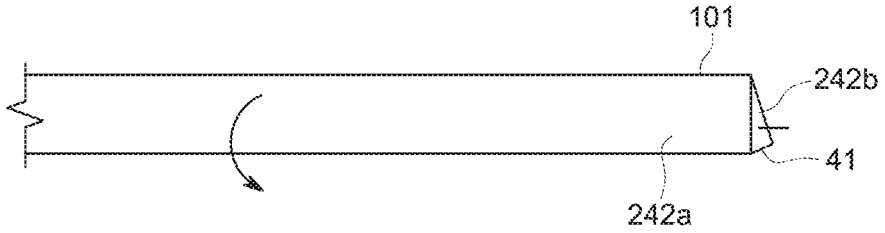
FIGS. 4A and 4B depict two different sides of load line presentation device with a baseline load line plimsoll mark and a decreased capacity load line plimsoll mark.
Figure 4B:
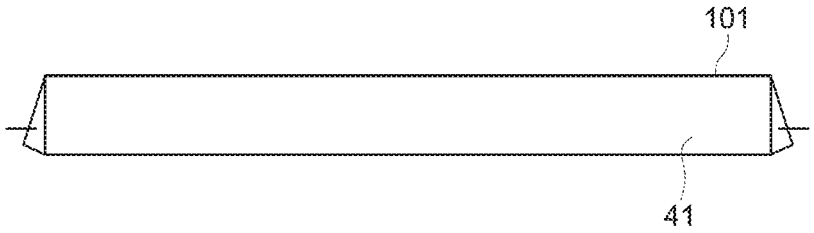

FIGS. 4A and 4B depict two different sides of load line presentation device with a baseline load line plimsoll mark 41 and a decreased capacity load line plimsoll mark 242*b*.

The load line presentation device can be a pivoting display device 101 attached to the buoyant hull wherein different sides of the pivoting display device show either a permanently affixed baseline load line indicator plimsoll mark 41 or one of two permanently affixed decreased capacity load line indicator plimsoll marks, wherein mark 242*a* and 242*b* are presented.

Figure 5A:
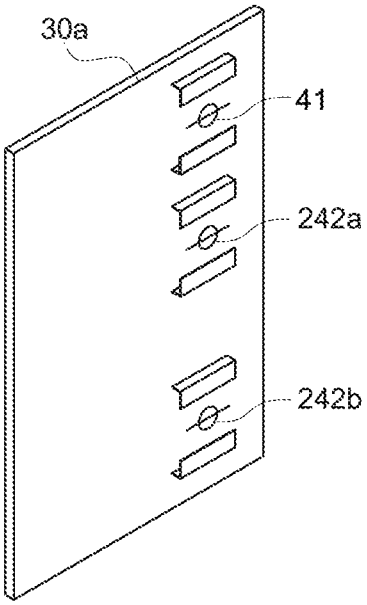
FIGS. 5A, 5B and 5C show three different embodiments of a load line presentation device with a baseline load line plimsoll mark and a plurality of decreased capacity load line plimsoll marks.
Figure 5B:
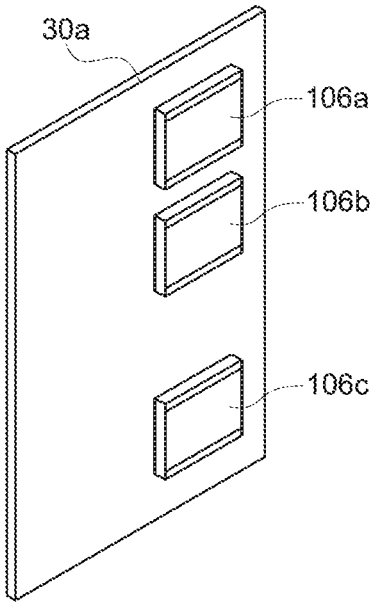
Figure 5C:
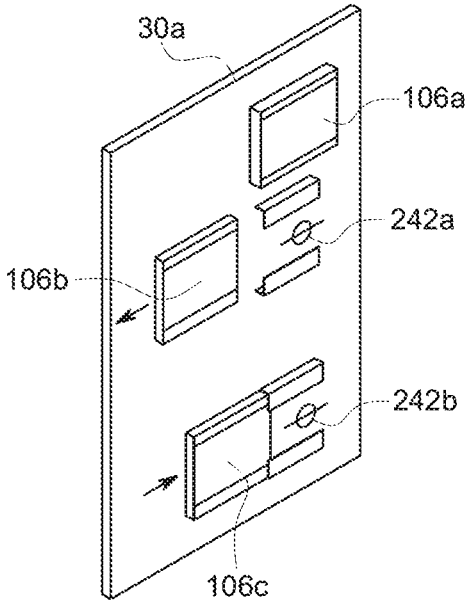
Figure 6A:
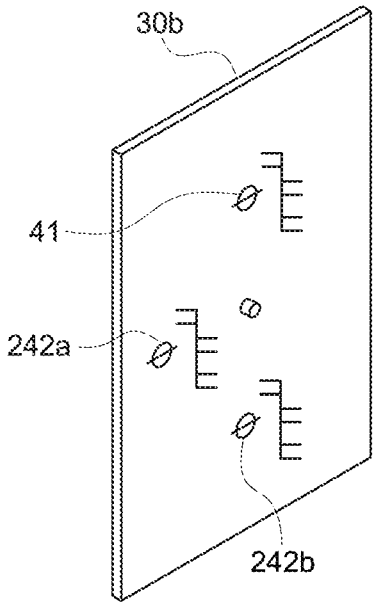
FIGS. 6A, 6B, 6C and 6D depict four plimsoll marks of a load line presentation device including a baseline load line plimsoll mark and a plurality of decreased capacity load line plimsoll marks.
Figure 6B:
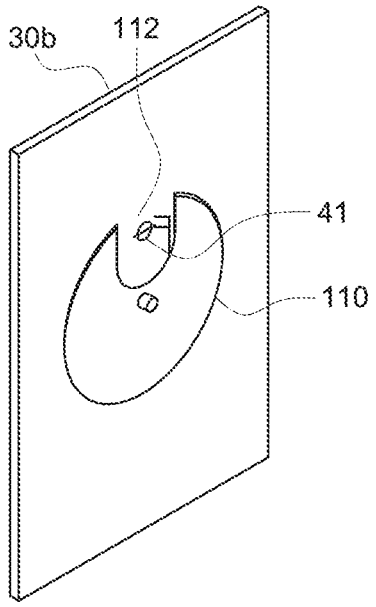
Figure 6C:
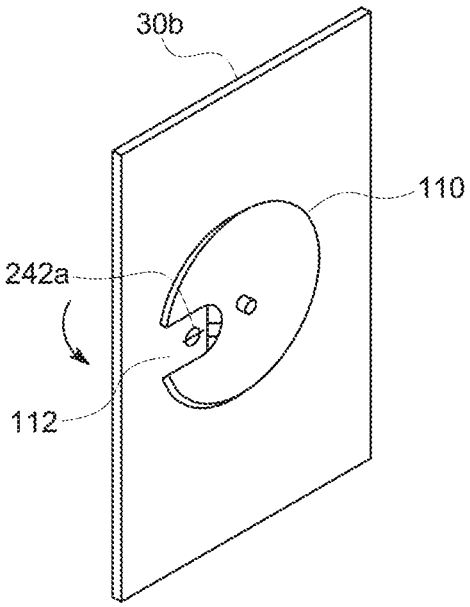
Figure 6D:
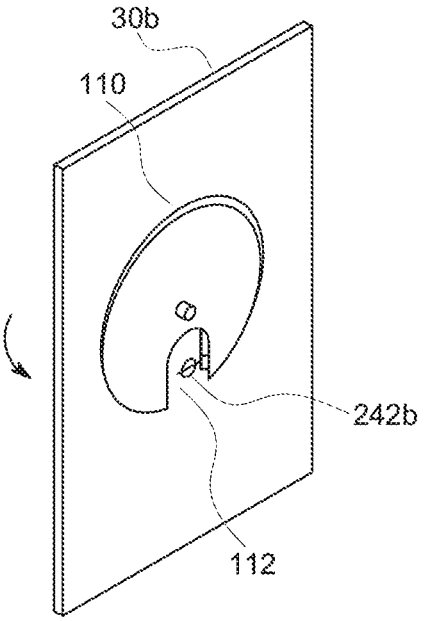

FIGS. 5A, 5B and 5C show three different embodiments of a load line presentation device with a baseline load line plimsoll mark 41 and a plurality of decreased capacity load line plimsoll marks 242*ab*.

In these three Figures, the load line presentation device 30*a* has three sleeves 106*a*, 106*b* and 106*c* which can selectively slide to reveal or hide a plimsoll mark.

The sliding sleeve 106*a* can selectively show a permanently affixed baseline load line indicator plimsoll mark 41.

The sliding sleeves 106*b* and 106*c* can selectively show permanently affixed decreased capacity load line indicator plimsoll marks 242*a* and 242*b*, respectively.

FIGS. 6A, 6B, 6C, and 6D depict four plimsoll marks of a load line presentation device including a baseline load line plimsoll mark and a plurality of decreased capacity load line plimsoll marks.

In these Figures, the load line presentation device 30*b* is a rotating wheel 110 mounted to a substructure. The rotating wheel 110 has a window 112.

The rotating wheel 110 is configured to turn and enable the window 112 to selectively present a baseline load line plimsoll mark 41 or alternatively decreased capacity load line plimsoll marks 242*a* or 242*b*.

FIGS. 7A, 7B, 7C, and 7D depict a light up electronic display 114 presenting an illuminated baseline load line plimsoll mark or one of a group of increased capacity load line plimsoll marks.

Figure 7A:
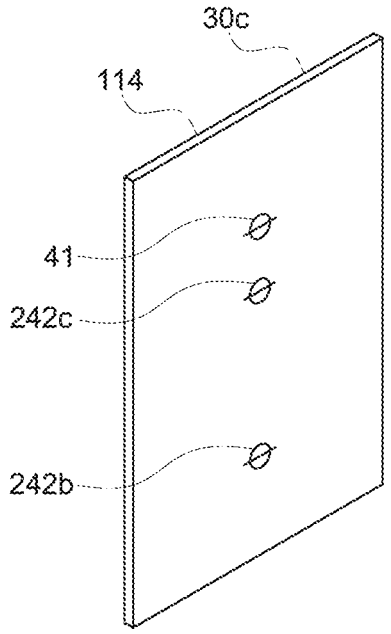
FIGS. 7A, 7B, 7C and 7D depict an electronic display presenting electrically a baseline load line plimsoll mark or one of a group of decreased capacity load line plimsoll marks.
Figure 7B:
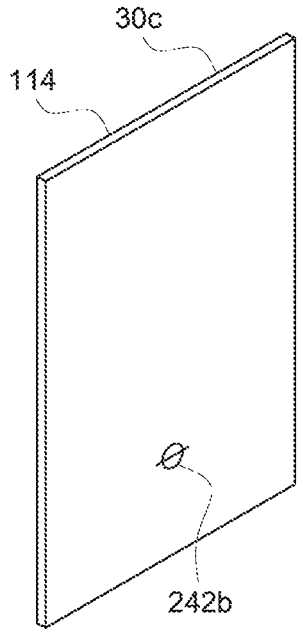
Figure 7C:
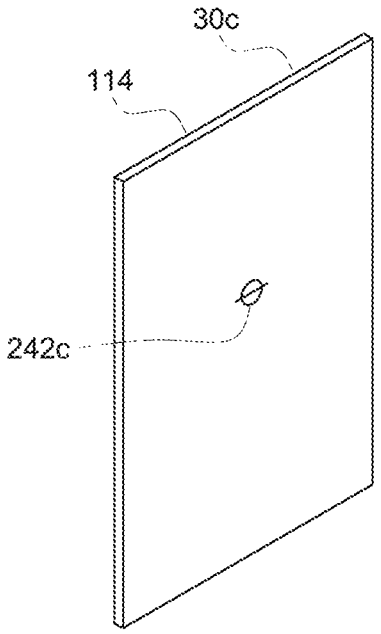
Figure 7D:
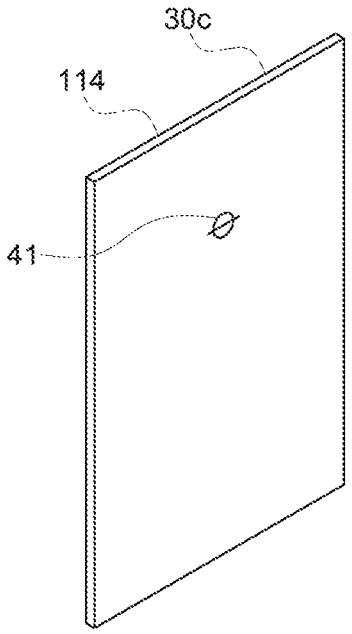
Figure 7E:
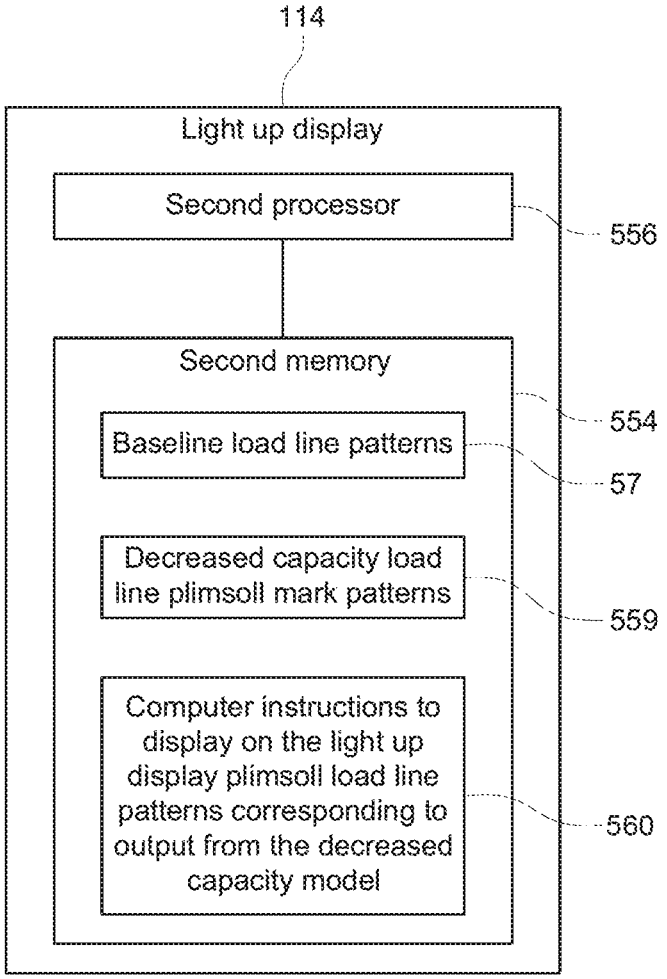
FIG. 7E depicts memory used with the electronic display.

The FIG. 7E is a diagram of a load line presentation device that can be a light up electronic display 114.

The light up electronic display 114 connects to ta second processor 556.

The second memory 554 containing baseline plimsoll load line mark patterns 57 and decreased capacity load line plimsoll mark patterns 559.

The second memory 554 includes computer instructions 560 to instruct the second processor 556 to display on the light up electric display, plimsoll load line mark patterns corresponding to output from the decreased capacity model.

In the embodiments, it is contemplated that the light up electronic display 114 is viewable for at least 200 yards from the floating vessel in clear weather.

In the embodiments, the light up electronic display has a length from 6 feet to 10 feet and a height from 6 feet to 10 feet and engages onboard floating vessel power.

Figure 8:
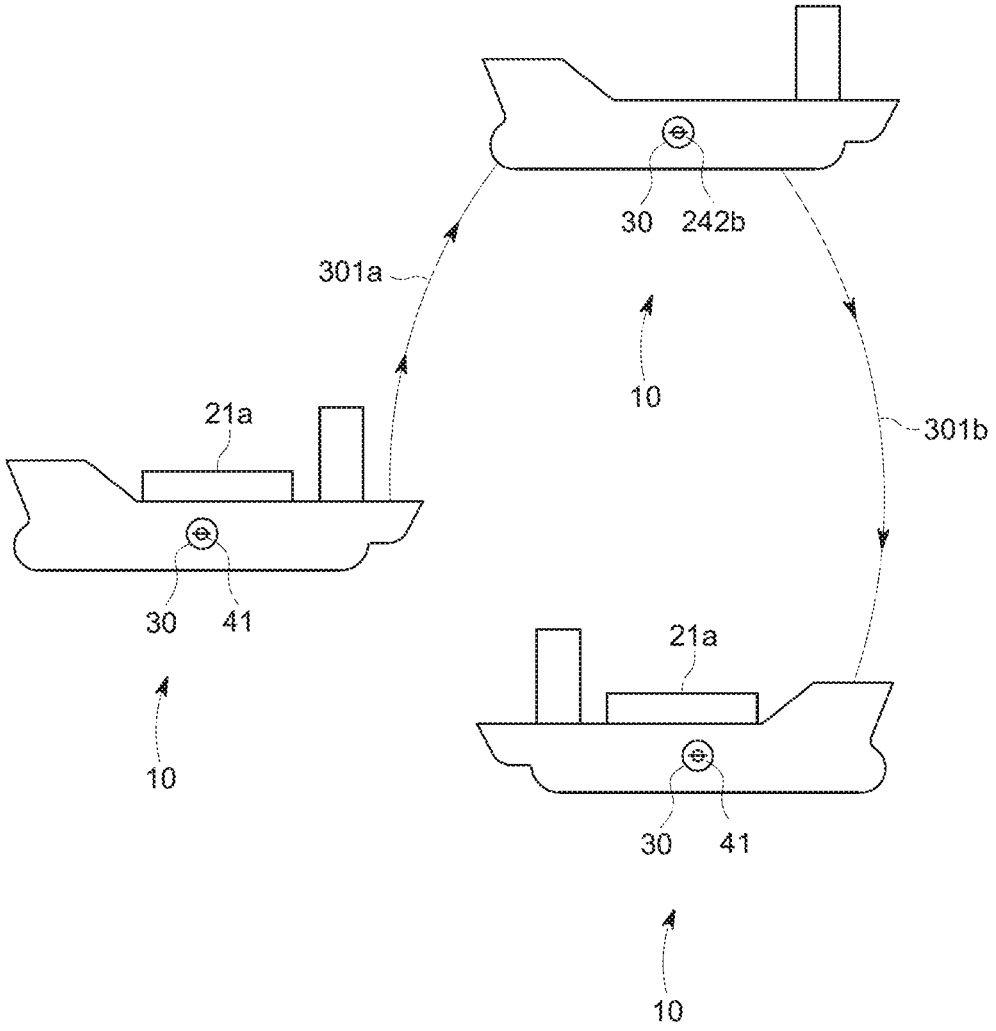
FIG. 8 depicts use of the invention as a ship sails from South Africa to Calcutta to Singapore.

FIG. 8 depicts use of the invention as a ship sails from South Africa to Calcutta to Singapore.

For this FIG. 8, the first and second processor and first and second memory automatically changes a baseline load line plimsoll mark to correspond to environmental criteria and instructions from the increased capacity model based on a navigation route 301*a* and 301*b* and based on weights of cargo 21*a* loaded and offloaded along the navigation route.

More specifically, FIG. 8 depicts a ship, the "Bluewater" traversing from South Africa with bad weather to Calcutta with mild weather to Singapore.

The load line presentation device 30 in South Africa is set at the baseline load line plimsoll mark 41 with cargo 21*a* having a first weight of 10,000 tons.

The floating vessel traverses navigation route 301*a*.

In Calcutta, the floating vessel changes the plimsoll mark to an decreased capacity plimsoll mark 242*b* in order to enter a narrow waterway, after it offloads container 21*a* which is 10,000 tons of cargo.

The changed mark is calculated by the decreased capacity model in memory (shown in earlier figures) using the first processor in an on board computer, or using cloud computing.

The changed mark, a decreased capacity load line indicator plimsoll mark corresponds to environmental criteria modified in the decreased capacity model based on a navigation route 301*b*, waterway depth, and based on weights of cargo loaded and offloaded along the navigation route 301*a* and 301*b*.

The floating vessel 10 reaches Singapore and takes on additional cargo 21*a*, and changes the plimsoll mark back to a baseline load line indicator plimsoll mark 41.

FIG. 9 is a table showing the decreased capacity model 379 for a barge and the specific conditions that define use of a baseline load line plimsoll mark 41 during a voyage and two decreased capacity load line plimsoll marks 242*a*, and 242*b*.

The decreased capacity model 379 is located in first memory 54 and connected to a first processor 56 which in turn is in communication with at least one of the load line presentation devices.

The decreased capacity model 379 is configured for automatically integrating at least four of the plurality of variables shown in the table of FIG. 9.

Those variables include: a wave size 202, a wave period 206, a wind speed 208, a surface current (in knots) 210, a length overall (of the buoyant hull) 212, a type of floating vessel 214, a quantity of disconnected superstructures (mounted to the buoyant hull) 216, a quantity of sheer (in degrees) 218, and a bow height 220 of the buoyant hull as measured from a keel.

For a type of floating vessel that is a barge (labelled as element 214) has a length over all (LOA) of 221 meters (shown as element 212), the baseline load line indicator plimsoll mark 41 is shown as "Deadweight" in FIG. 9. The Deadweight was computed based on: a wave size 202 is 45 feet, a wave period 206 of 11 seconds, a wind speed 208 of 70 knots, a surface current 210 of 0.75 knots, a quantity of disconnected superstructures (mounted to the barge) is labelled as element 216, the sheer value (zero) of the barge hull (in feet sustainable by the buoyant hull without deforming) is labelled as element 218, and the barge bow height is 8 meters, which is labelled as element 220.

For the baseline load line indicator plimsoll mark 41 shown as "Deadweight" in FIG. 9 a port specific draft restriction 222 is 7.6 meters, a waterway specific draft restriction 224 is 8.6 meters and a canal specific draft restriction 226 is shown as 9.6 meters.

For the same barge, a first decreased capacity load line indicator plimsoll mark 242*a*: is selected using a wave size 202 of 55 feet, a wave period 206 of 13 seconds, a wind speed 208 of 80 knots, a surface current 210 of 1.0 knots, a quantity (2) of disconnected superstructures (mounted to the barge) 216, a sheer value of the barge hull (in feet sustainable by the buoyant hull without deforming) remaining at zero and 218, and the barge bow height remaining at 8 meters, element 220.

For the first decreased capacity load line indicator plimsoll mark 242*a* in FIG. 9 a port specific draft restriction 222 is 7.4 meters, a waterway specific draft restriction 224 is 8.4 meters and a canal specific draft restriction 226 is shown as 9.4 meters.

For the same barge, a second decreased capacity load line indicator plimsoll mark 242*b*: is selected using a wave size 202 of 60 feet, a wave period 206 of 15 seconds, a wind speed 208 of 100 knots, a surface current 210 of 1.5 knots, a quantity (2) of disconnected superstructures (mounted to the barge) 216, a sheer value of the barge hull (in degrees sustainable by the buoyant hull without deforming) of zero element 218, and a barge bow height of 8 meters, labelled as element 220.

For the second decreased capacity load line indicator plimsoll mark 242*b* in FIG. 9 a port specific draft restriction 222 is 7.2 meters, a waterway specific draft restriction 224 is 8.2 meters and a canal specific draft restriction 226 is shown as 9.2 meters.

The decreased capacity model displays a calculated decreased capacity load line plimsoll mark for use on the load line presentation device 30*a*.

When the decreased capacity model 379 indicates the baseline load line indicator plimsoll mark can be hidden and a decreased capacity load line plimsoll mark can be used, the loadline presentation device displays the calculated decreased capacity load plimsoll mark reducing baseline capacity of the buoyant hull from 1% to 50%.

In embodiments, the load line presentation device is operable by electric power, hydraulic power, pneumatic power, manual power, and combinations thereof.

Figure 10:
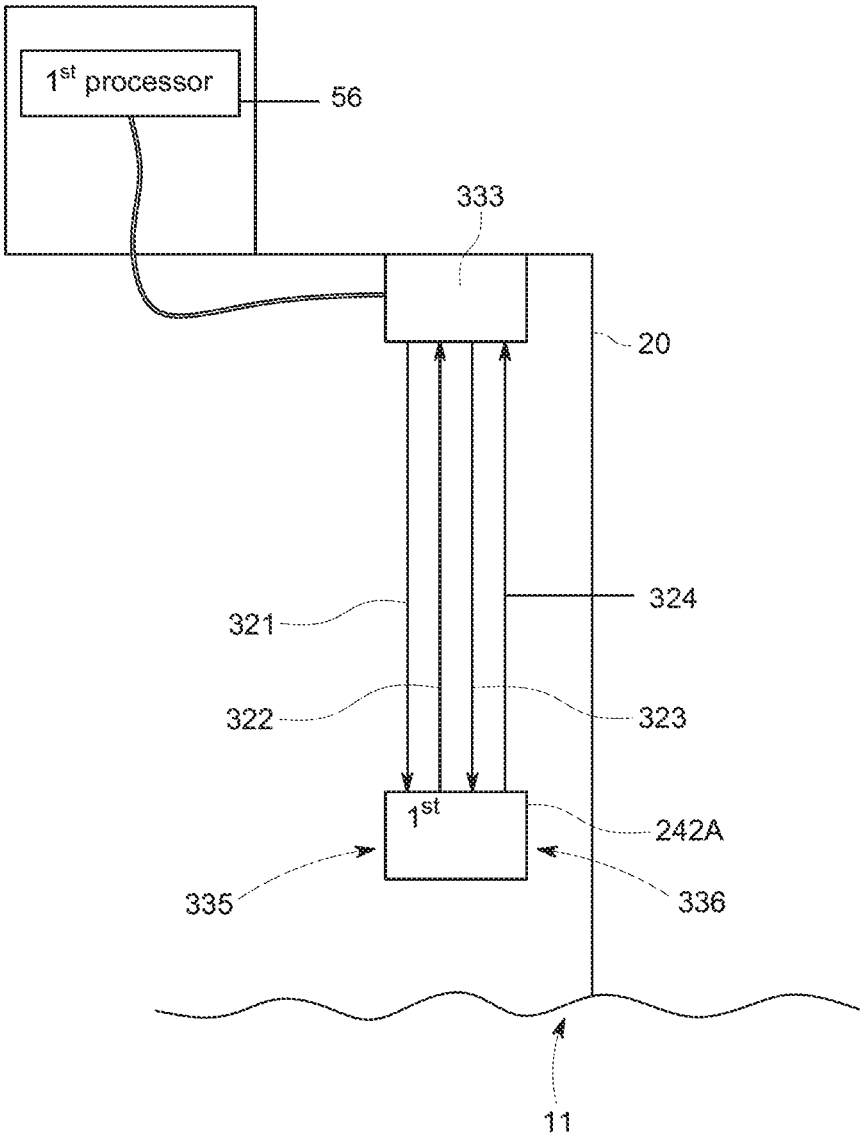
FIG. 10 depicts a position verification device on a hull.

FIG. 10 depicts a position verification device 333 in wired or wireless connection to the first processor 56 to verify the position of at least one decreased capacity load line indicator plimsoll marks 242*a*.

The position verification device 333 is secured to the hull 20 and is in wired or wireless connection to the first processor 56 to verify the position of at least one decreased capacity load line indicator plimsoll marks 242*a* affixed to the hull.

The position verification device 333 transmits a first signal 321 and records a first reflected signal 322 as an approved position 335 of each decreased capacity load line indicator plimsoll marks on the hull to the first processor as approved by a vessel regulatory agency.

The position verification device 333 transmits a second signal 323 and record a second reflected signal 324 identifying a second position 336 on the hull of each decreased capacity load line indicator plimsoll mark after a user defined unit of time.

The position verification device 333 compares the approved position 335 to the second position 336 to verify each decreased capacity load line indicator plimsoll mark is in the approved position.

In embodiments, the position verification device is an optical device or an acoustic device.

Example 1

A barge in sea water in summer is traversing between Dubai and Singapore.

The barge has a displacement of 11,000 baseline tons, a length overall of 220 meters, a beam of 40 meters, and a draft of 5 meters.

The buoyant hull of the barge is hauling cargo tubular steel.

The barge is required under International Convention on Load Lines signed in London, England, 5 Apr. 1966 amended by the Protocol of 1988 Relating to the International Convention on Load Lines, 1966 and Revised as International Convention on Load Lines, 1966 and Protocol of 1988 as amended Consolidated Edition, 2005 Supplement December 2013 to display corresponding to a baseline load line indicator plimsoll mark approved by American Bureau of Shipping (ABS).

A load line presentation device that is a rotating disc with window affixed to the buoyant hull without interrupting water flow along the buoyant hull.

In one window, the load line presentation device presents the baseline load line indicator plimsoll mark representing an unrestricted service criteria.

The baseline load line indicator plimsoll mark has a fresh water load line mark (F); a tropical fresh water load line mark (TF), a tropical salt water load line mark (T); a winter salt water load line mark (W); a summer salt water load line mark (S); and a winter North Atlantic salt water load line mark (WNA).

For this barge, the load line presentation device presents two decreased capacity load line indicator plimsoll marks.

Each decreased capacity load line plimsoll mark has a fresh water load line mark (F);

a tropical fresh water load line mark (TF), a tropical salt water load line mark (T); a winter salt water load line mark (W); a summer salt water load line mark (S); and a winter North Atlantic salt water load line mark (WNA).

On the barge is a first processor with first memory in communication with the load presentation device 30. The first memory contains known information about the barge.

In first memory is a decreased capacity model, a length over all of the buoyant hull of the barge, the type of floating vessel (a barge), a quantity (2) of disconnected superstructures mounted to the buoyant hull (one), a quantity of sheer, and a bow height of the buoyant hull as measured from a keel (8 meters).

The decreased capacity model is configured to automatically integrate the known information on the buoyant hull stored in memory with a maximum expected wave size to be encountered on the next voyage, a maximum wave period expected to be encountered on the next voyage, a maximum wind speed expected to be encountered on the next voyage, and a maximum surface current in knots expected to be encountered on the next voyage. The decreased capacity model can include depth in a port, depth in a canal or depth in a waterway.

The decreased capacity model takes the reduced cargo weight of the vessel and calculates and displays a calculated decreased capacity load line plimsoll mark for use on the load line presentation device.

The load line presentation device can be rotated to present through the window of the load line presentation device the corresponding decreased capacity load line plimsoll mark identified by the decreased capacity model.

The baseline load line indicator plimsoll mark is hidden and the barge now has an decreased cargo capacity to enter a shallow part, increasing the versatility of the barge while keeping the barge compliant with International Conversations on Load lines.

While these embodiments have been described with emphasis on the embodiments, it should be understood that within the scope of the appended claims, the embodiments might be practiced other than as specifically described herein.

What is claimed is:

1. A floating vessel in water comprising:

a. a buoyant hull for cargo, the buoyant hull having a draft, wherein the buoyant hull is required under International Convention on Load Lines 1966 signed in London, England, 5 Apr. 1966 amended by Protocol of 1988 relating to the International Convention on Load Lines, 1966 and revised as International Convention on Load Lines, 1966 and Protocol of 1988, as amended Consolidated edition, 2005 Supplement December 2013 to display of baseline load line indicator plimsoll mark;

at least one load line presentation device affixed to the buoyant hull without interrupting water flow along the buoyant hull the load line presentation device presenting:

i. a baseline load line indicator plimsoll mark representing an unrestricted service criteria, each baseline load line indicator plimsoll mark approved and issued by a vessel classification regulatory society further comprising:

(a) a fresh water load line mark;

(b) a tropical fresh water load line mark;

(c) a tropical salt water load line mark;

(d) a winter salt water load line mark;

(e) a summer salt water load line mark; and (f) a winter North Atlantic salt water load line mark; and ii. a plurality of decreased capacity load line indicator plimsoll marks, and wherein each decreased capacity load line plimsoll mark comprises:

i. a first fresh water load line mark;

ii. a first tropical fresh water load line mark;

iii. a first tropical salt water load line mark;

iv. a first winter salt water load line mark;

v. a first summer salt water load line mark; and vi. a first winter North Atlantic salt water load line mark;

b. a decreased capacity model in first memory connected to a first processor in communication with each load presentation device, the decreased capacity model configured for automatically integrate a plurality of variables including at least four of: a wave size, a wave period a wind speed, a surface current, a length over all of the buoyant hull, a type of floating vessel, a quantity of disconnected superstructures mounted to the buoyant hull, sheer value in degrees sustainable by the buoyant hull without deforming, a bow height of the buoyant hull as measured from a keel; a port specific draft restriction, a waterway specific draft restriction, a canal specific draft restriction and identifying a decreased capacity load line plimsoll mark for a voyage of the floating vessel, and wherein the decreased capacity model displays a calculated decreased capacity load line plimsoll mark for use on the load line presentation device; and when the decreased capacity model indicates the baseline load line indicator plimsoll mark can be hidden and a decreased capacity load line plimsoll mark can be used, the load line presentation device displays the decreased capacity load plimsoll mark restricting baseline capacity of the buoyant hull from 1% to 50%; and wherein the load line presentation device automatically changes which of the pre-calculated plimsoll marks is displayed, based on the environmental criteria, based on a navigation route and based on weights of cargo loaded and offloaded along the navigation route and depth of a waterway, canal or port.

2. The floating vessel of claim 1, comprising a locking system preventing access to a marine operations manual (MOM) for loading, carrying, and offloading cargo using only the baseline load line plimsoll mark, wherein the marine operations manual can be computer instructions in first memory connected to a first processor or printed marine operations manual in a locking enclosure.

3. The floating vessel of claim 1, wherein the load line presentation device is operable by electric power, hydraulic power, pneumatic power, manual power, or combinations thereof.

4. The floating vessel of claim 1, wherein the load line presentation device is a pivoting display device attached to the buoyant hull and different sides of the pivoting display device show a permanently affixed baseline load line indicator plimsoll mark and an decreased capacity load line indicator plimsoll mark.

5. The floating vessel of claim 1, wherein the load line presentation device has a sleeve and the sliding sleeve selectively shows a permanently affixed baseline load line indicator plimsoll mark or a plurality of decreased capacity load line indicator plimsoll marks.

6. The floating vessel of claim 1, wherein the load line presentation device is a rotating wheel with a window wherein the rotating wheel is configured to enable the window to selectively present a baseline load line plimsoll mark or a plurality of decreased capacity load line indicator plimsoll marks.

7. The floating vessel of claim 1, wherein the load line presentation device is a light up electronic display to selectively present a baseline load line plimsoll mark or a plurality of decreased capacity load line indicator plimsoll marks.

8. The floating vessel of claim 7, wherein the light-up electric display has a second processor with second memory, the second memory containing baseline plimsoll load line mark patterns and decreased capacity load line plimsoll mark patterns and computer instructions to instruct the second processor to display on the light-up electric display decreased capacity plimsoll load line mark patterns corresponding to output from the decreased capacity model.

9. The floating vessel of claim 7, wherein the light-up electronic display is viewable for at least 200 yards from the floating vessel in clear weather.

10. The floating vessel of claim 7, wherein the light-up electronic display has a length from 6 feet to 10 feet and a height from 6 feet to 10 feet and engages onboard floating vessel power.

11. The floating vessel of claim 1, comprising a position verification device in wired or wireless connection to the first processor to verify the position of at least one decreased capacity load line indicator plimsoll marks by:

a. transmit a first signal and record a first reflected signal as an approved position of each decreased capacity load line indicator plimsoll marks on the hull to the processor as approved by a vessel regulatory agency;

b. transmit a second signal and record a second reflected signal identifying a second position on the hull of each decreased capacity load line indicator plimsoll mark after a user defined unit of time; and c. compare the approved position to the second position to verify each decreased capacity load line indicator plimsoll mark is in the approved position.

12. The floating vessel of claim 11, wherein the position verification device is an optical device or an acoustic device.

* * * * *